US006435466B1

(12) United States Patent
Adams

(10) Patent No.: US 6,435,466 B1
(45) Date of Patent: Aug. 20, 2002

(54) DOCUMENT HOLDER

(76) Inventor: Maynard Le Roy Adams, 21901 Collier Ave., Battle Creek, MI (US) 49017

( * ) Notice: Subject to any disclaimer, the term of this patent is extended or adjusted under 35 U.S.C. 154(b) by 0 days.

(21) Appl. No.: 09/783,648

(22) Filed: Feb. 14, 2001

(51) Int. Cl.[7] ..... A47G 1/24

(52) U.S. Cl. ..... 248/455; 248/460

(58) Field of Search ..... 248/455, 444.1, 248/444, 460

(56) References Cited

U.S. PATENT DOCUMENTS 5,722,628 A * 3/1998 Menaged ..... 248/441.1
5,829,787 A * 11/1998 Newhouse, Jr. ..... 281/46
5,884,889 A * 3/1999 Crosby ..... 248/460
5,918,848 A * 7/1999 Rini ..... 248/441.1
6,270,049 B1 * 8/2001 Olvey ..... 248/441.1

* cited by examiner

*Primary Examiner*—Leslie A. Braun
*Assistant Examiner*—A. Joseph Wujciak, III

(57) ABSTRACT

A document holder that is easily adjustable in the vertical as well as in tilt, with a ledge for holding a page, several pages or a book in an ergonomically correct position and is compact and portable. The document holder includes the document support plate (40) with the lower protruding support ledge (43) for supporting documents or a book thereon, the base plate (41) the support brace (42) with which to support and hold the document support plate (40) and the base plate (41) in predetermined and easily adjustable vertical angles in relationship to each other. The adjustable document holding clasp (45) of a clear flexible material for gripping and holding pages and for use as a operators movable reference guide for documents or a book. A flexible hook and loop fastening material (44) substantially attached to the document support plate (40) and base plate (41) and support brace plate (42) provide a method of connecting that allows support and adjusting and hinging of the document support plate (40) relative to the base plate (41). Use of a hook and loop fastening material (44) as a connector and a hinge allows considerable vertical angle adjustments and allows the document support plate (40) and support plate ledge (43) to be adjusted in varying positions and angles and increments by an operator including positions level with or considerably below the common work table or desk top. The document holder design and the use of said fastening material provides an exceptionally durable versatile device providing easy setup or collapse to a compact size for storage, carry or transport.

2 Claims, 8 Drawing Sheets

DOCUMENT HOLDER

CROSS-REFERENCE TO RELATED APPLICATIONS

Not Applicable

STATEMENT REGARDING FEDERALLY SPONSORED RESEARCH OR DEVELOPMENT

Not Applicable.

REFERENCE TO A MICROFICHE APPENDIX

Not Applicable

BACKGROUND

1. Field of the Invention

This invention relates to document holders, specifically to provide a low-cost lightweight durable support and holder for documents that provide a ergonomically correct position for an operator.

2. Description of Prior Art

Adjustable document or book stands are well known in the art and while these devices are quite satisfactory inasmuch as their directional adjustability is concerned. Several may be moved in the vertical and may be tilted to face the viewer, they are not satisfactory for many numerous preferred applications and do not fulfill all of the basic requirements mentioned in the several preferred design descriptions that follow;

A useful universal holder for documents must satisfy several basic requirements;

1. it must be capable of positioning the document to be readily viewed by the reader,
2. it must be capable of holding many different forms of documents or material and have a method to hold a page or hold a book open with the pages held back;
3. it must be easily set up for use by anyone including a young, elderly or disabled person;
4. it must be easily manufactured from a readily available material at a reasonable cost;
5. it must be of a durable design and material to provide a reasonable length of useful life;
6. it must be light weight and portable and easily setup and collapsed;
7. it must not have any metal that might trip metal detectors which are more frequently used now;
8. a desirable design would allow someone not able to afford to purchase a manufactured document holder could easily purchase readily available materials and make their own. This would provide many children and low-income persons to benefit from my document holder design;

Many prior art document holders must be placed to one side of the computer rather than between the computer display and keyboard. This placement forces the computer operator to constantly look to the left or right to view copy, often causing neck and back strain, as well as resulting in inefficient work. The placement to one side makes it difficult to see print because it is placed at a greater distance from the viewer. Placement of a document holder to one side of the computer monitor and keyboard uses and or blocks valuable desktop space and must frequently compete for space with other items or blocks the access of disks from the computer.

Prior art document holders frequently have many parts which must be manufactured and assembled, increasing the cost. Prior art includes several attempts to create inline document holders as well as a number of document holders which are designed to be held at the side of the monitor. Prior art document holders have performed well for some of these applications but often use very complex and expensive assemblies. Someone searching for a document holder for a particular application would often have to find and purchase more than one design to fulfill the requirement for an individuals particular unique application they want to perform.

The present document holder generally relates to the special needs of youth or small percentile persons while still being adaptable to many other applications such as computer work stations, and more particularly to a document holder which is adapted to a keyboard drawer or keyboard shelf which is commonly mounted below the work surface which holds the computer monitor.

It is desirable to hold a document or a book in position between a keyboard and a monitor so that a person working at a computer work station can more easily transcribe or edit materials on the computer without having to turn to one side to look at a document. It is also desirable to provide a copy holder which holds copy in direct line of sight of and closer to the user. It is also desirable to easily remove a copy holder from a work surface when not in use to make more efficient use of a work surface.

Keyboard drawers, which are extended from a desk or cabinet, are positioned underneath a computer monitor work surface and are typically used when there is need for additional room for placement of a keyboard, or there is need for more work surface when a computer is not in use. The general limitation to providing a document holder which is in direct line of sight with the monitor screen and the keyboard is a lack of depth of a traditional work surface. There is usually not room between a computer monitor and a keyboard to provide for a inline document holder.

A keyboard drawer provides a method for support of a keyboard beyond the edge of a work surface and provides a convenient method of removing and storage of the keyboard in order to free the work surface for other use. A need exists for a copy holder adapted for use with a keyboard drawer to provide more efficient use of a work surface. Such a copy holder not only does not infringe on the limited space of a traditional work surface but also increases working space by providing additional work space when the keyboard is extended. Room is thereby provided for a document holder, which is also in an ergonomically correct direct line of sight of the user, the keyboard, document and computer monitor.

U.S. Pat. No. 3,954,314 to Crawford, issued on May 4, 1976, describes a paint box easel combination. A detachable lid for a base functions as a palette. An upright member having a bail fits into rib notches through the base center to adjust the angle of the easel upright to the tray. An easel extension slides in an upright socket and is fixed in extension for painting. The present document holder is an inline copy holder adapted for use with a keyboard drawer or shelf The present document holder has no upright socket nor does it have an easel extension. An object of the present document holder is limitation of the number of parts and ease of manufacture resulting in a durable yet economic method for holding copy material in a comfortable and ergonomic position.

U.S. Pat. No. 4,162,055 to Summers, issued on Jul. 24, 1979, describes a copy holding device having a pivotally mounted support column and a support platform telescopically connected. It further includes a base assembly of a multi-layer construction and a projecting flange portion with a pivot pin. The support column has a vertically spaced upper and lower end section and a generally horizontally extending section disposed between the interconnecting end sections. The present document holder does not have a support column and does not have a pivot pin. It is the object of the present document holder to minimize the number of parts in order to achieve economic manufacture. The present document holder can be economically manufactured. It is the object of the present document holder to be easily setup or disassembled and removable for easy access to a computer disk drive and for easy storage of the copy holder. It is an object of the present invention to provide a sturdy document holder. The present document holder has past test with a use and load support of over ten pounds on the vertical support plate and lower document support ledge in a position extending beyond and below a common work surface or desk while in a vertical upright document holding position.

SUMMARY

The present invention relates to a durable universal document holder that is easily manufactured, easily set up and easily collapsed for commuting and travel, and holds documents and books with pages held open in a ergonomically readable position, and provides that the user have their hands free for other work. The present invention discloses a document holder that is adjustable in the vertical as well as in tilt and which utilizes a document ledge which is adjustable level with or considerably below the common work surface as in over a desk or table edge. The document holder includes the document support plate and attached thereto the lower protruding support plate ledge for supporting documents or a book thereon, the base plate, the support brace with which to support and hold document support plate and base plate in predetermined and easily adjustable vertical angles in relationship to each other. The present invention also provides the document holding clasp of a transparent flexible material for gripping and holding of pages, or as a movable and adjustable reference guide for documents or holding a book pages open. The present invention provides a novel method to connect and adjust the document holder assembly by the use of a flexible hook and loop fastening material. Use of a hook and loop fastening material substantially mounted to the document support plate and the base plate and the support brace plate provide a method of connecting, hinging and adjusting of the document support plate relative to the base plate. Use of a hook and loop fastening material as a connector and a hinge allows considerable vertical angle adjustments and allows the document support plate ledge to be easily adjusted to varying positions level with or below the common work table or desk. A hook and loop fastening material as applied in this design also provides a quick and easy method to collapse the document holder for easy storage and transporting. Although the preferred embodiment is fabricated from plastic components, it should be understood by those familiar with the art that other materials such as wood, hardboard or various metals would be appropriate.

OBJECTS AND ADVANTAGES

Besides the objects and advantages of the document holder described in my patent, several objects and advantages of the present invention are:

1. To provide a document holder capable of fulfilling document or copy holding requirements for many diversified applications and individual stature.
2. To provide a document holder that would allow for documents and a book to be placed in line with and in front of user.
3. To provide a document holder that would allow the user to easily adjust the document and book holder to a level which would be more ergonomically correct and comfortable depending on the stature of the person and the dimension and configuration of a particular work area.
4. To provide a document holder that would allow individuals to procure readily available inexpensive materials to make and assemble the design for themselves.
5. To provide a document holder that would provide that documents and copy could be placed in the small available area on the surface of a desk or table in front and in line with a computer monitor and above a keyboard when a keyboard is commonly contained in or on a movable drawer.
6. To provide a document holder that would allow that the document or copy could easily be adjusted below the surface of a table or desk commonly used to hold the monitor in a position as to prevent the document or copy from blocking the monitor screen or interfering with the keyboard located in a keyboard drawer or shelf
7. To provide a document holder that would allow youths and a person of small stature could place the document or copy at a level that would be ergonomically correct and comfortable by allowing the document or copy to be easily adjusted below the level of a common work surface.
8. To provide a document holder that would allow support for documents or copy on the lap of a person as in a chair a couch or a bed and provide easily adjustable support angles as to provide a ergonomically correct and more comfortable read and write position. This would be especially desirable for the increasing number of commuters who read and write while traveling.

BRIEF DESCRIPTION OF THE DRAWINGS

Other objects, advantages, and novel features of the present, invention will become apparent from the following descriptions of the document holder when considered in conjunction with the accompanying drawings included;

Drawing Sheet 1/8

FIG. 1 is slightly enlarged over sheets 2/8 through 8/8 for clarity;

FIG. 2 is slightly enlarged over sheets 2/8 through 8/8 for clarity;

Drawing Sheet 2/8

Figure 3:
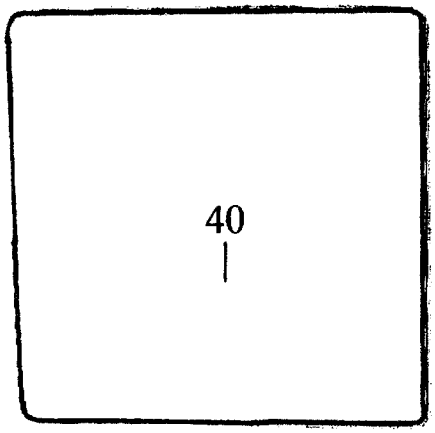
Figure 4:
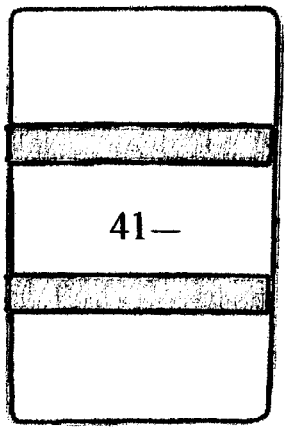
Figure 5:
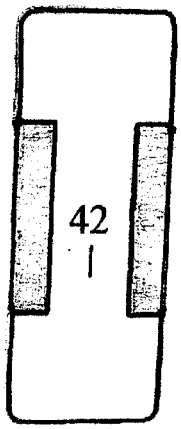
Figure 6:
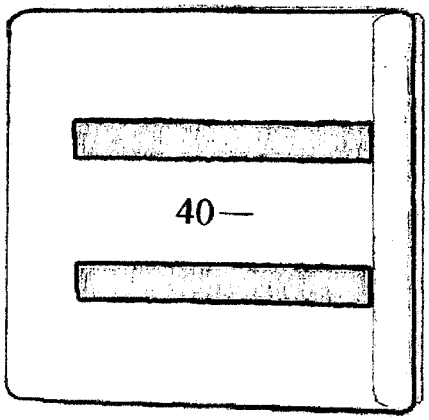
Figure 7:
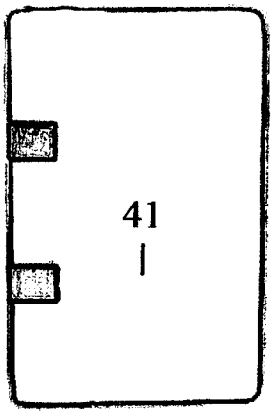
Figure 8:
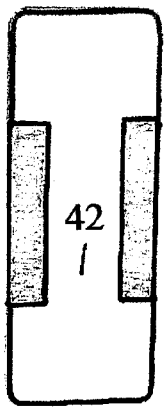

FIG. 3 is a top view of the document support plate;

FIG. 4 is a top view of the base plate. Shaded areas depict a flexible hook and loop fastening material;

FIG. 5 is a top view of the support brace plate. Shaded areas depict a flexible hook and loop fastening material;

FIG. 6 is a bottom view of the document support plate. Shaded areas depict a flexible hook and loop fastening material;

FIG. 7 is a bottom view of the base plate. Shaded areas depict a flexible hook and loop fastening material;

FIG. 8 is a bottom view of the support brace plate. Shaded areas depict a flexible hook and loop fastening material;

Drawing Sheet 3/8

Figure 9:
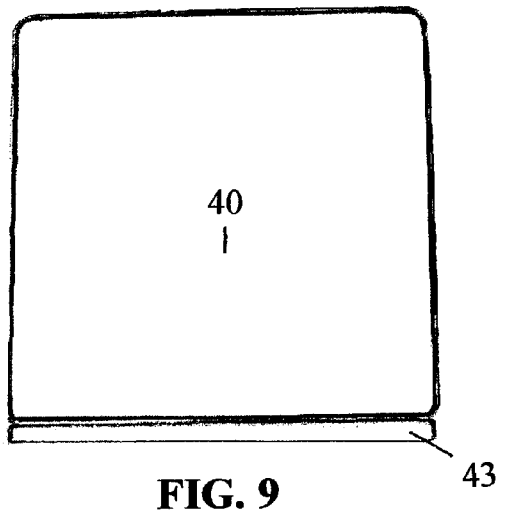
Figure 10:
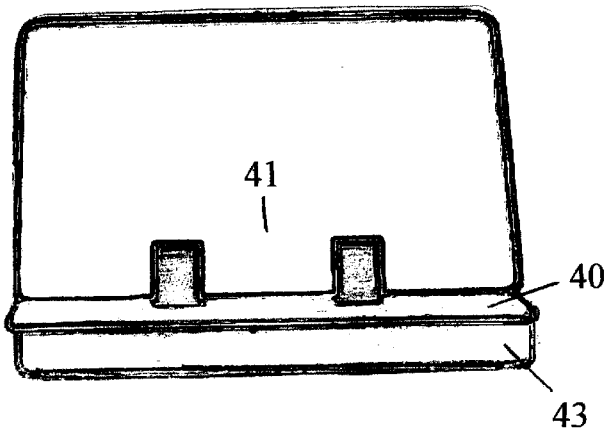
Figure 11:
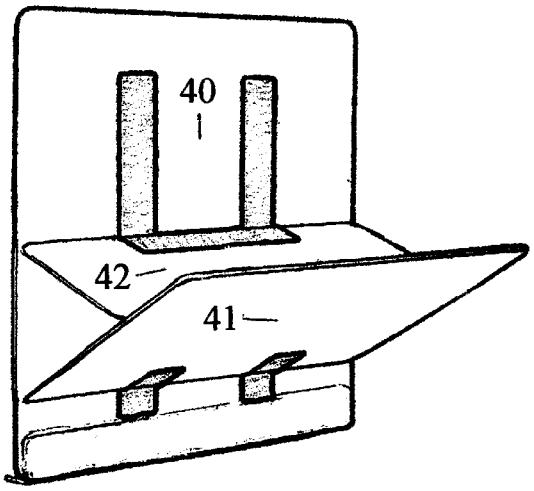
Figure 12:
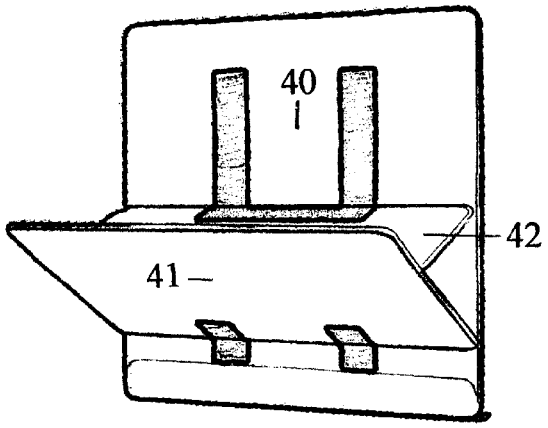

FIG. 9 is a front side elevated view of the document holder assembly;

FIG. 10 is a bottom side elevated perspective view of the document holder assembly. Shaded areas depict a flexible hook and loop fastening material;

FIG. 11 is a bottom right side perspective view of the document holder assembly. Shaded areas depict a flexible hook and loop fastening material;

FIG. 12 is a bottom left side perspective view of the document holder assembly. Shaded areas depict a flexible hook and loop fastening material;

Drawing Sheet 4/8

Figure 13:
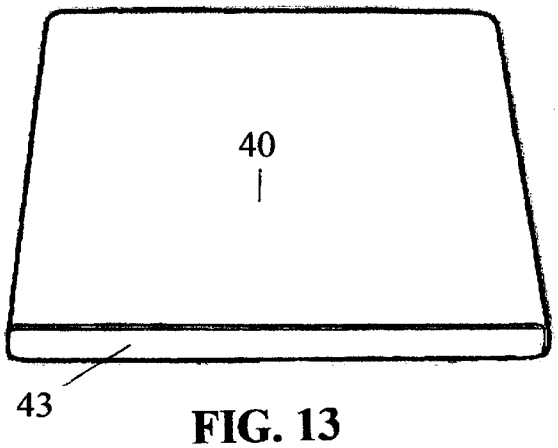
Figure 14:
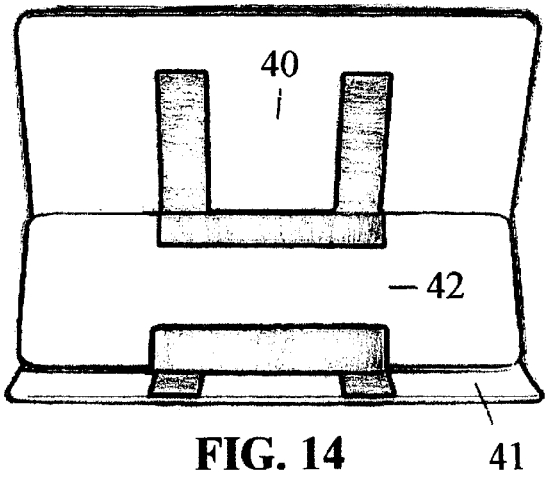
Figure 15:
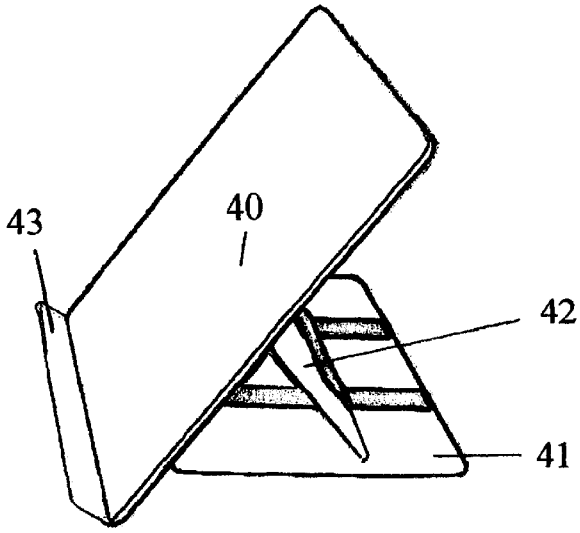
Figure 16:
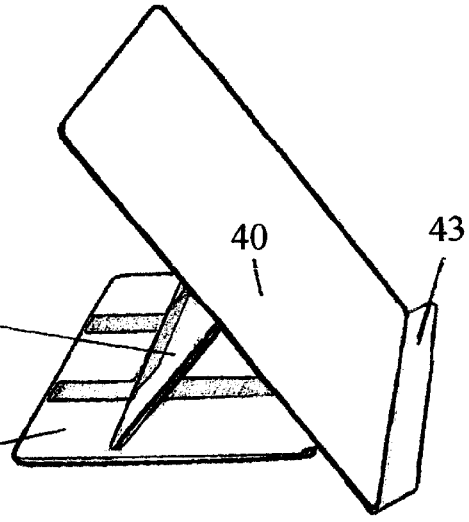

FIG. 13 is a front side perspective view of the document holder assembly;

FIG. 14 is a backside elevated perspective view of the document holder assembly. Shaded areas depict a flexible hook and loop fastening material;

FIG. 15 is a right side elevated perspective view of the document holder assembly. Shaded areas depict a flexible hook and loop fastening material;

FIG. 16 is a left side elevated perspective view of the document holder assembly. Shaded areas depict a flexible hook and loop fastening material;

Drawing Sheet 5/8

FIG. 17, FIG. 18, FIG. 19, FIG. 20, FIG. 21, FIG. 22, FIG. 23, FIG. 24, and FIG. 25 are views that show some examples of the versatility in adjustments and configurations to fit many varied applications of the document holder assembly;

Drawing Sheet 6/8

Figure 26:
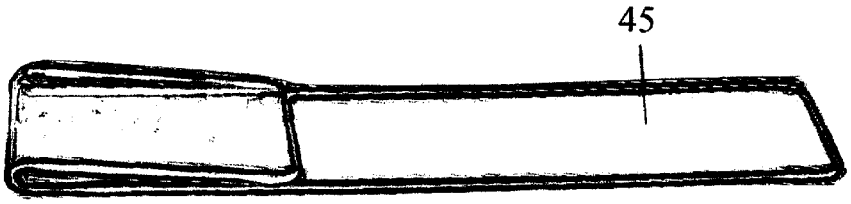
Figure 27:
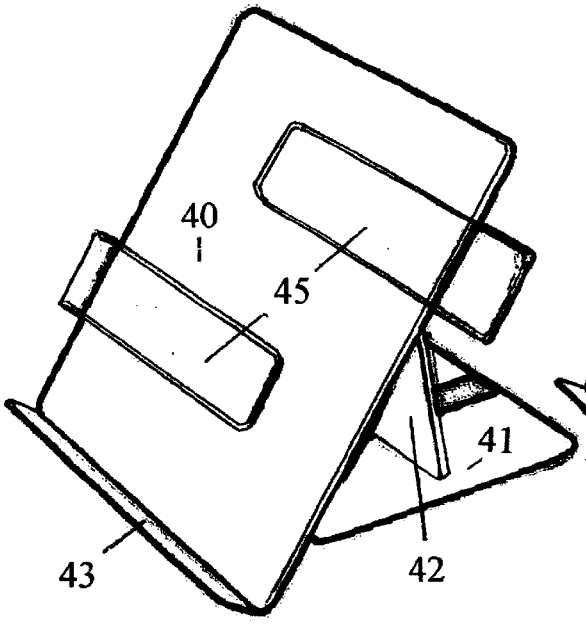
Figure 28:
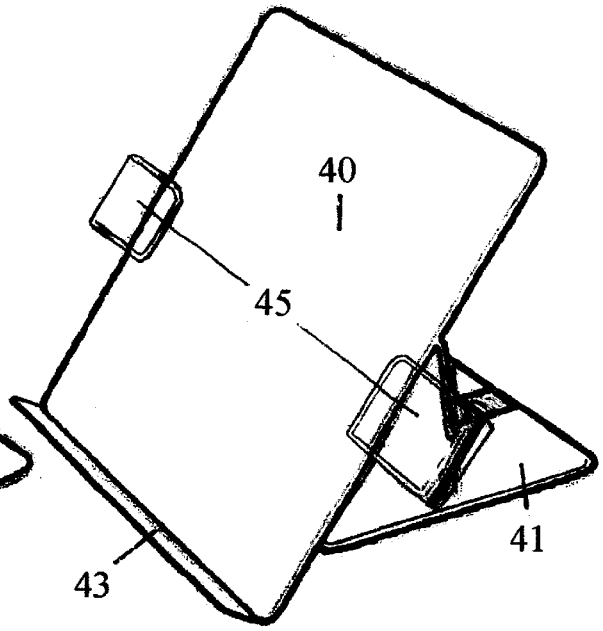

FIG. 26 is a side elevated perspective view of the book or document holding clasp. The clasp is made of transparent flexible material and is placed to hold documents and serves as an adjustable reference guide when the longer leg of the clasp is placed on the front of the document support plate over a document. The clasp serves as a book holder to hold book pages open when the shorter leg of the clasp is placed on the front of the support plate and over the outer edges of a book pages. FIG. 26 is enlarged for clarity;

FIG. 27 is a front right side elevated perspective view of the document holder assembly with the document holding clasp placed on the document support plate as a sheet or document holder and reference guide;

FIG. 28 is a front right side elevated perspective view of the document holder assembly with the document holding clasp placed on the document support plate as a book page holder;

Drawing Sheet 7/8

Figure 29:
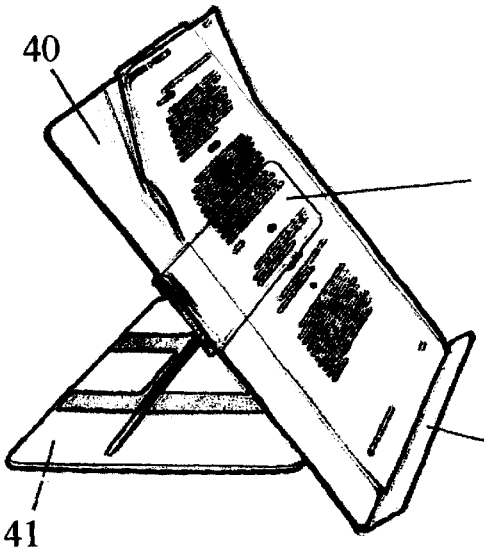
Figure 30:
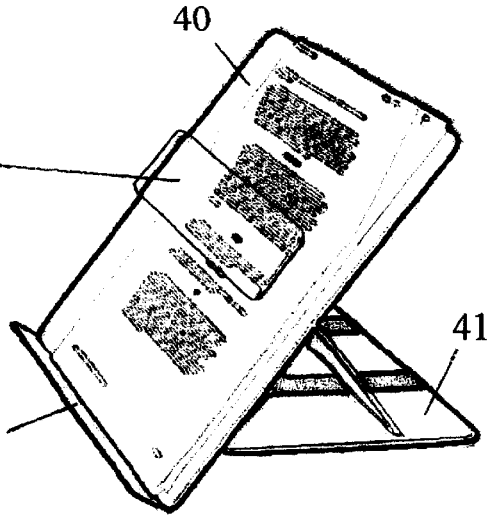
Figure 31:
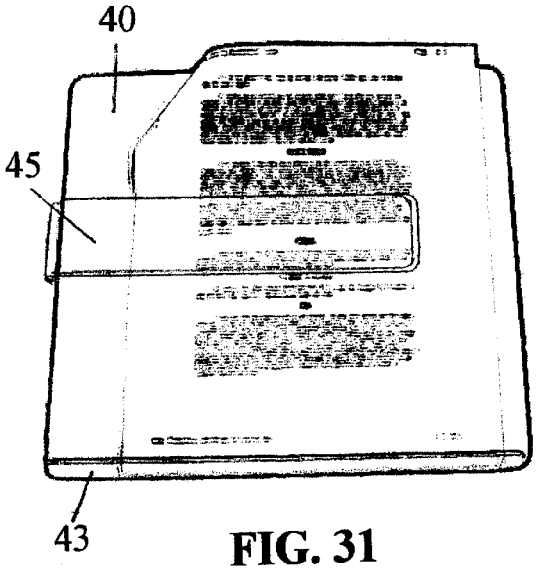
Figure 32:
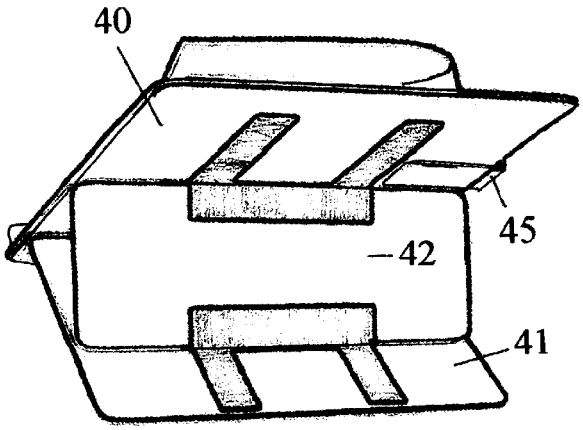

FIG. 29 is a front left side elevated perspective view of the document holder assembly with the document holding clasp placed to hold a document and serve as an adjustable transparent reference guide that may be slid up and down by an operator;

FIG. 30 is a front right side elevated perspective view of the document holder assembly with the document holding clasp placed in a manner to hold a document and serve as an adjustable transparent reference guide that may be slid up and down by an operator;

FIG. 31 is a front side elevated perspective view of the document holder assembly with the document holding clasp placed in a manner to hold a document and serve as an adjustable transparent reference guide that may be slid up and down by an operator;

FIG. 32 is a rear right side elevated perspective view of the document holder assembly with the document holding clasp placed in a manner to hold a document and serve as an adjustable transparent reference guide that may be slid up and down by an operator;

Drawing Sheet 8/8

Figure 33:
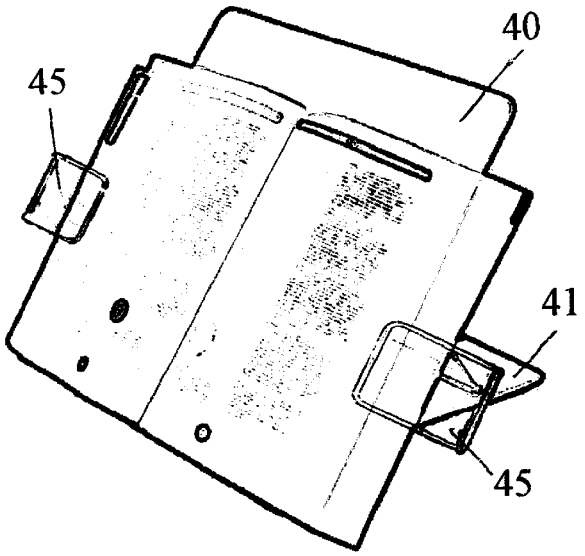
Figure 34:
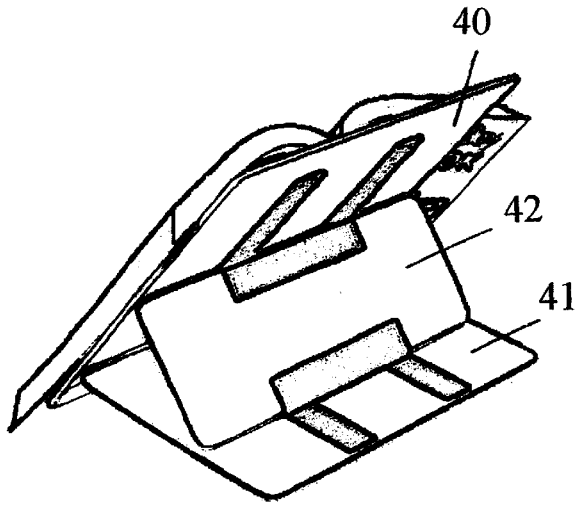
Figure 35:
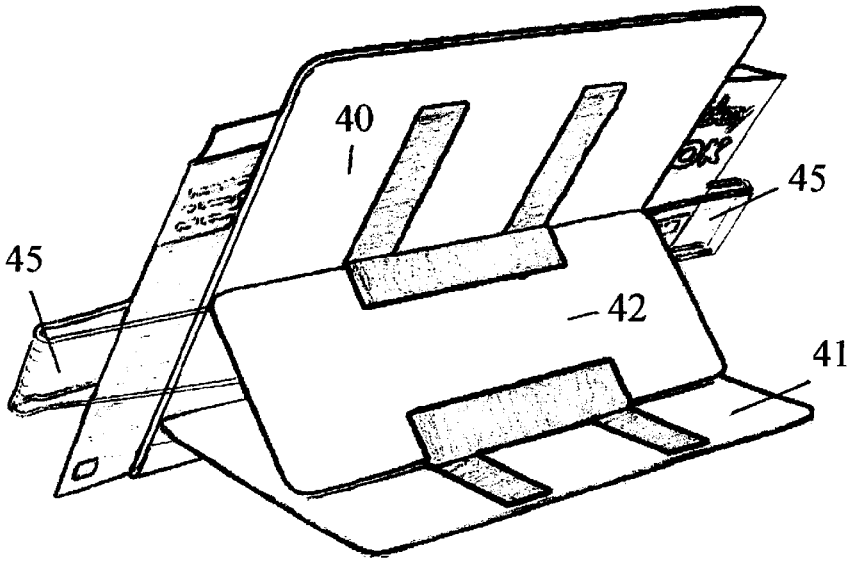

FIG. 33 is a front right side elevated perspective view of the document holder assembly with the document holding clasp placed in a manner to hold a book pages open;

FIG. 34 is a rear right side elevated perspective view of the document holder assembly supporting a book;

FIG. 35 is a rear right side elevated perspective view of the document holder assembly with the document holding clasp placed in a manner to hold a book pages open. Enlarged for clarification;

REFERENCE NUMERALS IN DRAWINGS

| | |
|---|---|
| 40 vertical document support plate | 43 support plate ledge |
| 41 baseplate | 44 hook and loop fastening material |
| 42 support brace plate | 45 document holding clasp |

DETAILED DESCRIPTION OF THE DRAWINGS

Referring now to the drawings, wherein like reference numerals designate identical or corresponding parts throughout the several views, the document holder is depicted in;

Drawing Sheet 1/8

Figure 1:
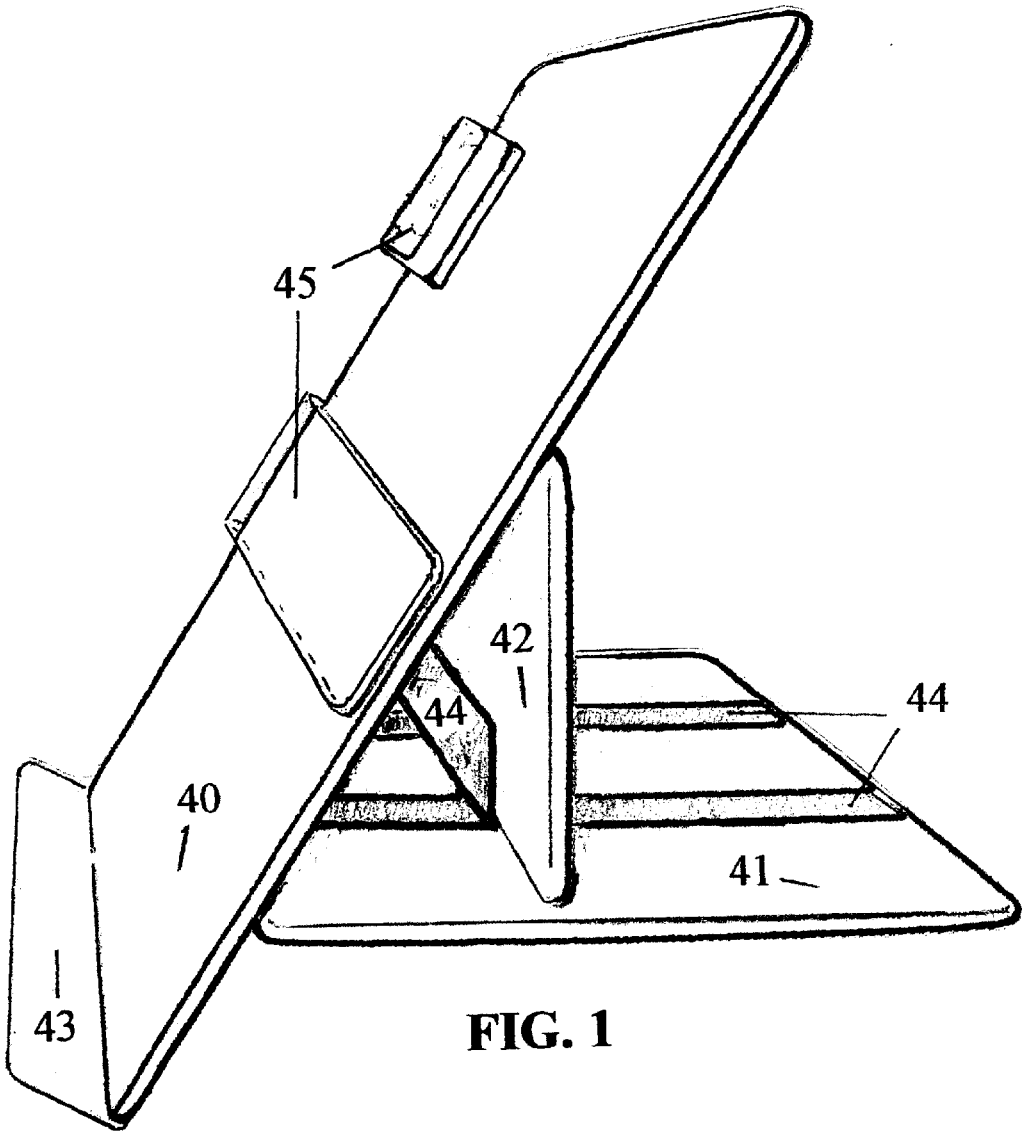
FIG. 1 is a front right side elevated perspective view of the document holder assembly with the document holding clasp shown in two different positions and configurations; shaded areas depict a flexible hook and loop fastening material.

FIG. 1 is a front right side elevated perspective view and can be seen to include the vertical document support plate 40 and the base plate 41 and the vertical support brace plate 42 and the document support plate ledge 43 and the movable document holding clasp 45 and a flexible hook and loop fastening material 44 further depicted by shading. FIG. 1 is slightly enlarged over sheets 2/8 through 8/8 for clarification.

Figure 2:
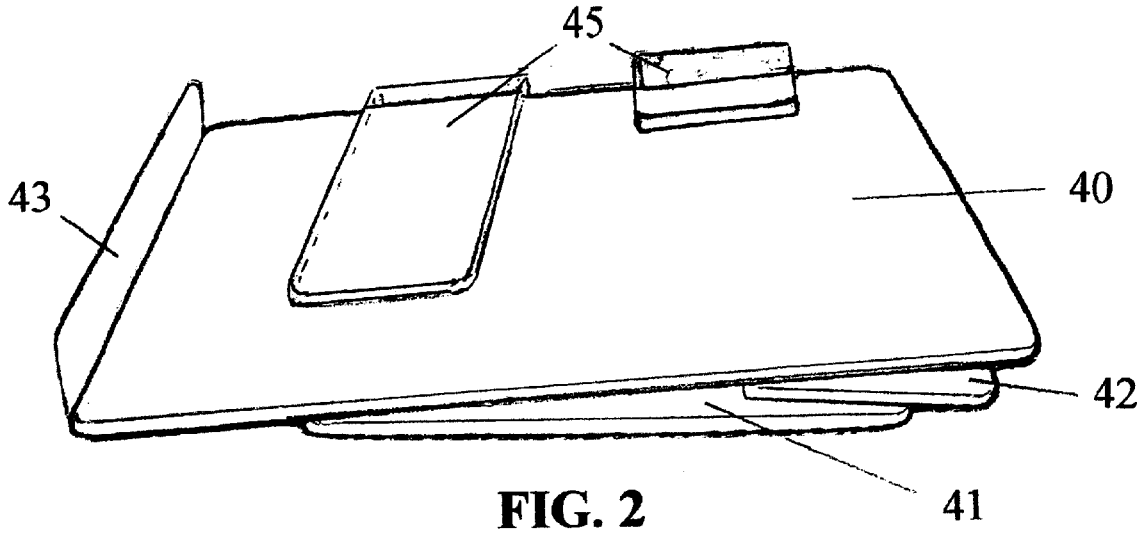
FIG. 2 is a front right side elevated view of the document holder in a closed and folded position. The document holding clasp is shown as a sheet holder and a book holder.

FIG. 2 is a front right side elevated perspective view of the document holder in a closed and folded position and can be seen to comprise the vertical document support 40 and the base plate 41 and the vertical support brace 42 and the document support plate ledge 43 and the movable document holding clasp 45. FIG. 2 is slightly enlarged over sheets 2/8 through 8/8 for clarification;

Drawing Sheet 2/8

FIG. 3 is a top view of the document support plate 40.

FIG. 4 is a top view of base plate 41. Shaded areas depict a hook and loop material.

FIG. 5 is a top view of the support brace plate 42. Shaded areas depict said fastening material 44.

FIG. 6 is a bottom view of the document support plate 40. Shaded areas depict said fastening material 44.

FIG. 7 is a bottom view of the base plate 41. Shaded areas depict said fastening material 44.

FIG. 8 is a bottom view of the support brace plate 42. Shaded areas depict said fastening material 44;

Drawing Sheet 3/8

FIG. 9 is a front view of the document holder assembly showing the document support plate 40 and the document support plate ledge 43.

FIG. 10 is a bottom side perspective view of the document holder assembly showing the document support plate 40 and the base plate 41 and the support plate ledge 43. Shaded areas depict a flexible hook and loop fastening material;

FIG. 11 is a bottom right side perspective view of the document holder assembly showing the document support plate 40 and the base plate 41 and the brace plate 42. Shaded areas depict a flexible hook and loop fastening material.

FIG. 12 is a bottom left side perspective view of the document holder assembly showing the document support plate 40 and the base plate 41 and the brace plate 42. Shaded areas depict a flexible hook and loop fastening material;

Drawing Sheet 4/8

FIG. 13 is a front perspective elevated view of the document holder assembly showing the document support plate 40 and the support plate ledge 43;

FIG. 14 is a backside perspective elevated view of the document holder assembly showing the document support plate 40 and the base plate 41 and the support brace plate 42. Shaded areas depict a flexible hook and loop fastening material 44;

FIG. 15 is a front right side elevated perspective view of the document holder assembly showing the document support plate 40 and the base plate 41 and the support brace plate 42 and the support plate ledge 43. Shaded areas depict a flexible hook and loop fastening material 44;

FIG. 16 is a front left side elevated perspective view of the document holder assembly showing the document support plate 40 and the base plate 41 and the support brace plate 42 and the support plate ledge 43. Shaded areas depict a flexible hook and loop fastening material 44, Drawing Sheet 5/8

Figure 17:
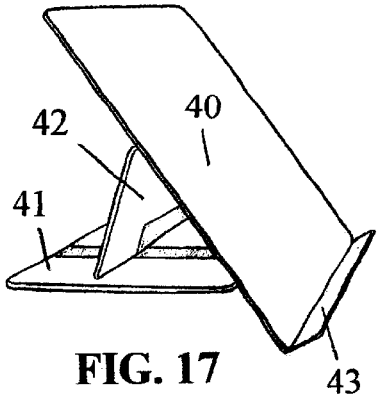
Figure 18:
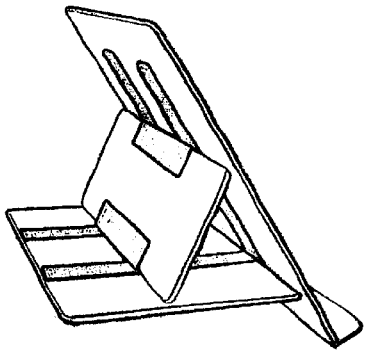
Figure 19:
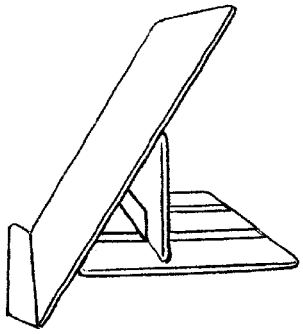
Figure 20:
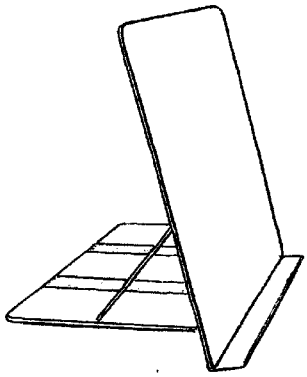
Figure 21:
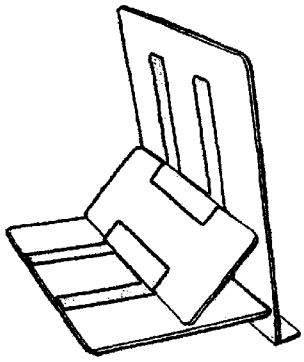
Figure 22:
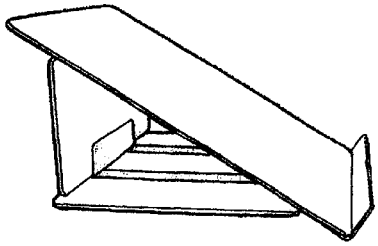
Figure 23:
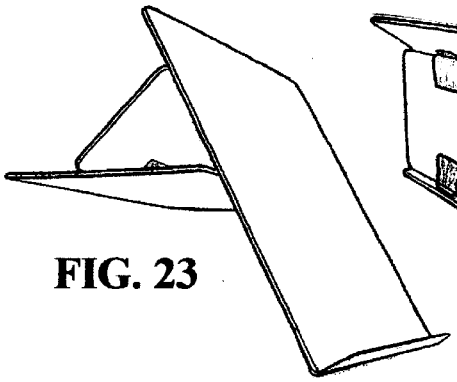
Figure 24:
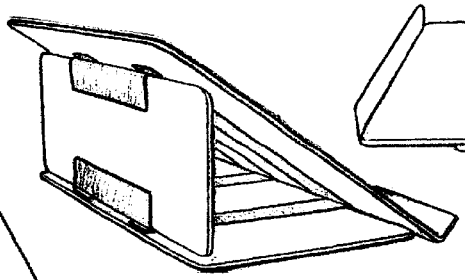
Figure 25:
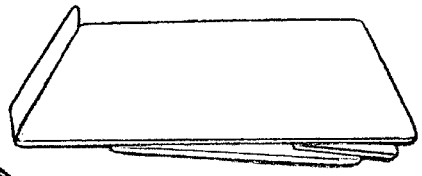

Drawing Sheet 5/8 are views of some examples of the versatility in adjustments and configurations of the document holder assembly. Views FIG. 17 to FIG. 25 depict the four main parts of the document holder as heretofore identified which can be seen and are obvious to those skilled in the art;

FIG. 17 is a front left side elevated perspective view showing the document support plate 40 the base plate 41 the support brace plate 42 the support plate ledge 43, FIG. 18 is a rear left side elevated view;

FIG. 19 is a front right side elevated view;

FIG. 20 is a front left side elevated view showing a steep document support plate angle;

FIG. 21 is a rear left side elevated view showing a steep document support plate angle;

FIG. 22 is a front left side elevated view showing a flatter document support plate angle;

FIG. 23 is a front left side elevated view adjusted to a lowest point below the work surface;

FIG. 24 is a rear left side elevated view showing a flatter angle of the support plate;

FIG. 25 is a front right side elevated view of the document holder assembly collapsed.

Drawing Sheet 6/8

FIG. 26 is a perspective elevated view of the document holding clasp and book page clasp. The clasp is made of transparent flexible material and is easily placed to hold documents to the front of the document support plate and serves as an adjustable reference guide. The clasp allows an operator to see the document through the clasp, when the longer leg of the clasp is placed on the front of the document support plate over a document, as is shown in FIG. 27. The clasp serves as a book holder to hold book pages open when the shorter leg of the clasp is placed on the front of the document support plate and over the outer edges of the book pages as shown in

FIG. 28.

FIG. 26 is enlarged for clarity;

FIG. 27 is a front right side elevated perspective view of the document holder assembly showing the document support plate 40 and the base plate 41 and the support brace plate 42 and the support plate ledge 43 and the document holding clasp 45. The clasp is placed on the document support plate in a manner to serve as a see through, adjustable sliding document holder and reference guide;

FIG. 28 is a front right side elevated perspective view of the document holder assembly showing the document support plate 40 and the base plate 41 and the support plate ledge 43 and the document holding clasp 45 placed on the document support plate 40 in a manner to serve as a book pages holder;

Drawing Sheet 7/8

FIG. 29 is a front left side elevated perspective view of the document holder assembly showing the document support plate 40 and the base plate 41 and the support plate ledge 43 and the document holding clasp 45 shown in a manner as to hold a document and serve as a page holder and transparent movable reference guide for an operator;

FIG. 30 is a front right side elevated perspective view of the document holder assembly showing the document support plate 40 and the base plate 41 and the support plate ledge 43 and the document holding clasp 45 shown in a manner as to hold a document and serve as a adjustable transparent reference guide for an operator;

FIG. 31 is a front side elevated perspective view of the document holder assembly showing the document support plate 40 and the support plate ledge 43 and the document holding clasp 45 placed in a manner to hold a document and serve as a adjustable see through transparent guide for an operator;

FIG. 32 is a rear right side elevated perspective view of the document holder assembly showing the document support plate 40 and the base plate 41 and the support brace plate 42 and the document holding clasp 45 placed in a manner to hold a document and serve as an adjustable transparent reference guide for an operator;

Drawing Sheet 8/8

FIG. 33 is a front right side elevated perspective view of the document holder assembly showing the document support plate 40 and the base plate 41 and the document holding clasp 45 placed in a manner to hold a book pages open;

FIG. 34 is a rear right side elevated perspective view of the document holder assembly showing the document support plate 40 and the base plate 41 and the support brace plate 42 supporting a book. Shaded areas depict a hook and loop flexible fastening material.

FIG. 35 is a rear right side elevated perspective view of the document holder assembly showing the document support plate 40 and the base plate 41 and the support brace plate 42 and the document holding clasp 45 shown in a manner to hold a book pages open. Shaded areas depict a hook and loop fastening material. View is enlarged for clarification;

While the document holder has been described with a certain degree of particularity, it is manifest that many changes may be made in the details of construction and materials and the arrangement of the components without departing from the spirit and scope of the disclosure. It is therefore to be understood that the document holder is not limited to the embodiment set forth herein for the purposes of exemplification, but is to be limited only by the scope of the appended claims, including the full range equivalency to which each element thereof is entitled.

I claim:

1. A document holder for supporting a reading or writing material comprising:

a support plate having a front and back side with four edges forming a perimeter, said back side of said support plate having an elongated hook and loop fastener, a base plate having a top and bottom side with a front and rear edge and a pair of side edges, said front edge has a hook and loop fastener thereon for connecting said base plate to said back side of said support plate in a plurality of adjustable positions, a support brace plate has a front and back sides with top, bottom, and side edges, said top edge having a hook and loop fastener for securing said support brace plate to said support plate in a plurality of adjustable positions and said bottom edge of said support brace plate having a hook and loop fastener for securing said support brace plate to said base plate in a plurality of adjustable positions, a support plate ledge mounted on the bottom edge of said support plate and extending generally orthogonal to the support plate for supporting a document, and wherein said hook and loop fastener located on said support plate and base plate have a longitudinal extent sufficient for said support brace plate to be removably and adjustably mounted therebetween to provide said support plate with an angle support, said support brace plate being totally removable from said support plate and said base plate when said document holder is in a stored condition.

2. A document holder for supporting a reading or writing material comprising:

a support plate having a front and back side with four edges forming a perimeter, said back side of said support plate having an elongated hook and loop fastener, a base plate having a top and bottom side with a front and rear edge and a pair of side edges, said front edge has a hook and loop fastener thereon for connecting said base plate to said back side of said support plate in a plurality of adjustable positions, a support brace plate has a front and back sides with top, bottom, and side edges, said top edge having a hook and loop fastener for securing said support brace plate to said support plate in a plurality of adjustable positions and said bottom edge of said support brace plate having a hook and loop fastener for securing said support brace plate to said base plate in a plurality of adjustable positions, a support plate ledge mounted on the bottom edge of said support plate and extending generally orthogonal to the support plate for supporting a document, an elongated rigid transparent clasp being vertically slidable on said supporting plate, and wherein said hook and loop fastener located on said support plate and base plate have a longitudinal extent sufficient for said support brace plate to be removably and adjustably mounted therebetween to provide said support plate with an angle support, said support brace plate being totally removable from said support plate and said base plate when said document holder is in a stored condition.

* * * * *